US005509385A

United States Patent [19]

LaVieri

[11] Patent Number: 5,509,385

[45] Date of Patent: Apr. 23, 1996

[54] HYDRAULIC LASH ADJUSTER METERING VALVE

[75] Inventor: David J. LaVieri, Tallahassee, Fla.

[73] Assignee: Precision Engine Products Corp., Tallahassee, Fla.

[21] Appl. No.: 490,624

[22] Filed: Jun. 15, 1995

[51] Int. Cl.[6] ..... F01M 9/10

[52] U.S. Cl. ..... 123/90.35; 123/90.36; 123/90.43

[58] Field of Search ..... 123/90.33, 90.35, 123/90.36, 90.43, 90.45, 90.46, 90.55; 184/6.5, 6.9

[56] References Cited

U.S. PATENT DOCUMENTS

| | | | |
|---|---|---|---|
| Re. 25,154 | 4/1962 | Bergmann . | |
| Re. 25,974 | 3/1966 | Dadd . | |
| 2,964,027 | 12/1960 | Dadd | 123/90.35 |
| 3,128,749 | 4/1964 | Dadd . | |
| 3,139,078 | 6/1964 | Slooten | 123/90.35 |
| 3,379,180 | 4/1968 | Kabel et al. . | |
| 3,430,613 | 3/1969 | Barnes . | |
| 3,439,659 | 4/1969 | Bouwkamp . | |
| 3,439,660 | 4/1969 | Bouwkamp . | |
| 3,448,730 | 6/1969 | Abell, Jr. . | |
| 3,450,228 | 6/1969 | Wortman et al. . | |
| 3,502,058 | 3/1970 | Thompson . | |
| 3,805,753 | 4/1974 | Bergmann et al. | 123/90.36 |
| 3,838,669 | 10/1974 | Dadd | 123/90.35 |
| 3,877,445 | 4/1975 | Barnes | 123/90.35 |
| 3,902,467 | 9/1975 | Cornell | 123/90.35 |
| 4,004,558 | 1/1977 | Scheibe | 123/90.35 |
| 4,009,696 | 3/1977 | Cornell | 123/90.35 |
| 4,227,495 | 10/1980 | Krieg | 123/90.55 |

*Primary Examiner*—Weilun Lo

*Attorney, Agent, or Firm*—Dorn, McEachran, Jambor & Keating

[57] ABSTRACT

A hydraulic lash adjuster for use in internal combustion engines has a cylindrical body with an internal chamber and a hollow plunger cap which is reciprocal within the body. One end of the plunger cap extends outwardly from the body and there is a fluid passage extending through the plunger cap end to communicate with the hollow interior of the plunger cap. There are fluid pressure feed openings in side walls of the body and plunger cap to supply fluid to the hollow interior of the plunger cap. There is a spring urging the plunger cap outwardly from the body. The plunger cap hollow interior has a generally conical metering valve seat at the internal termination of the plunger cap end fluid passage. There is a metering valve positioned within the plunger cap hollow interior and with a generally semi-spherical metering surface formed and adapted to seat against the metering valve seat. The semi-spherical metering surface has a fluid passage formed therein communicating with the plunger cap end fluid passage and the hollow interior of the plunger cap whereby a metered amount of fluid is provided from the interior of the plunger cap to the outwardly-extending end thereof during vehicle internal combustion engine operation.

12 Claims, 2 Drawing Sheets

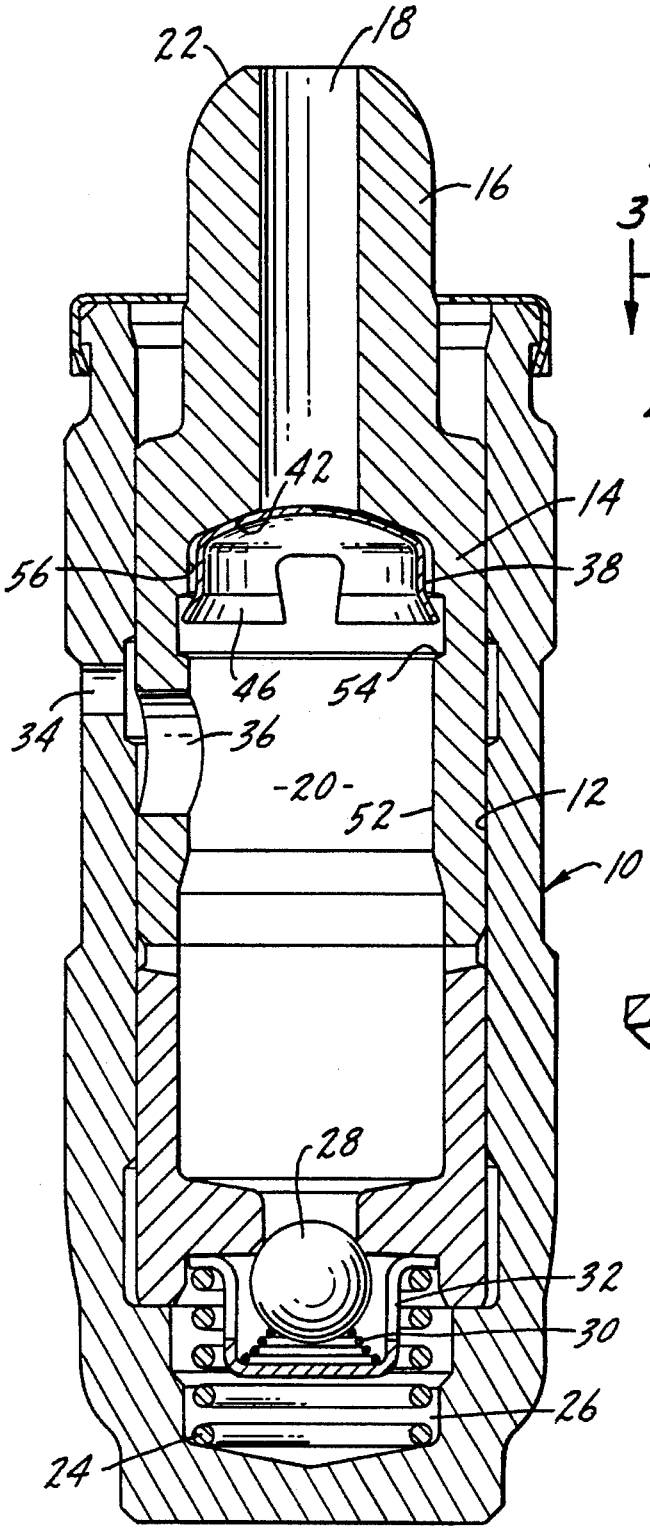
Fig.1.
Fig.2.
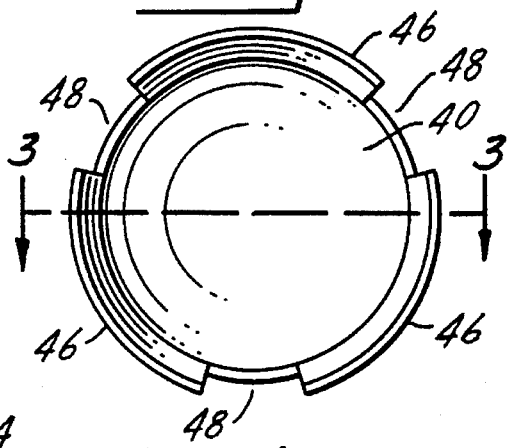
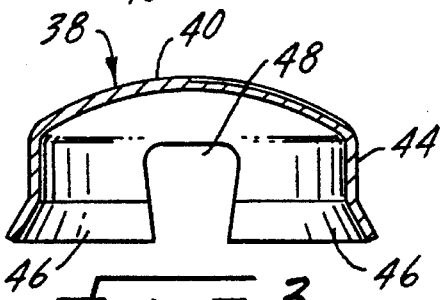
Fig.3.
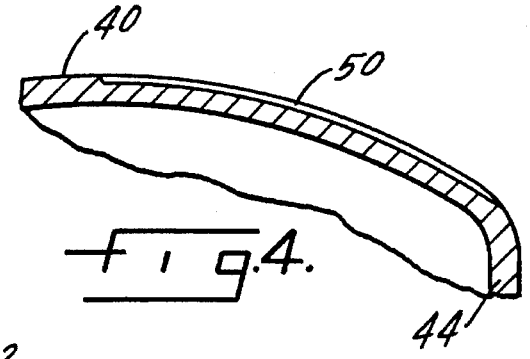
Fig.4.
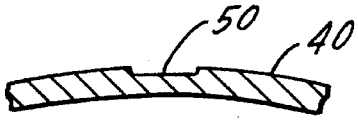
Fig.5.

Fig. 6.
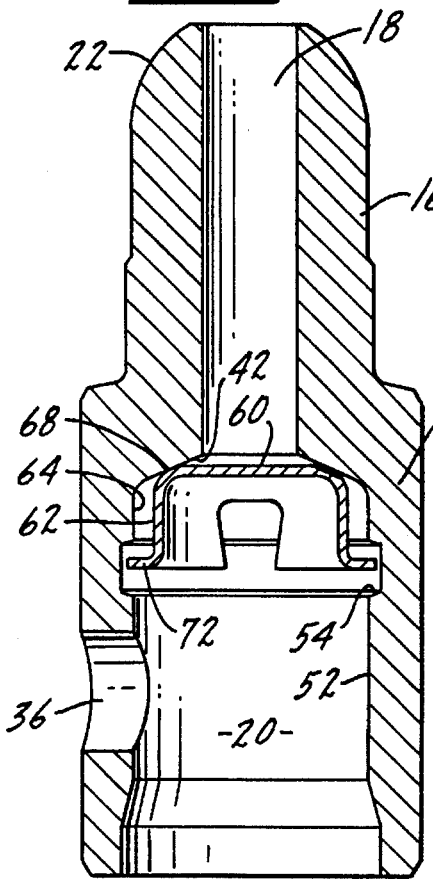
Fig. 10.
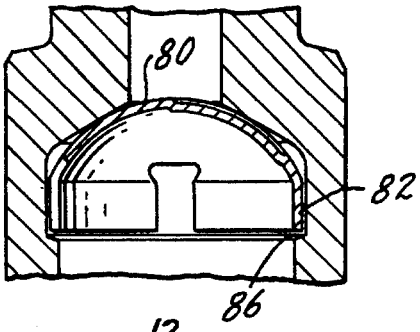
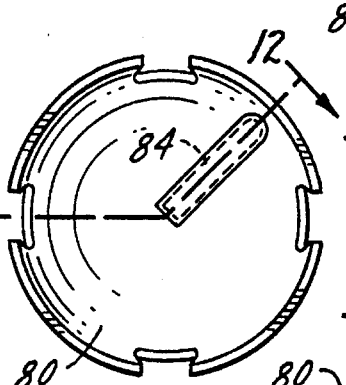
Fig. 11.
Fig. 12.
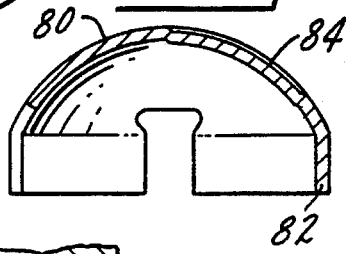
Fig. 7.
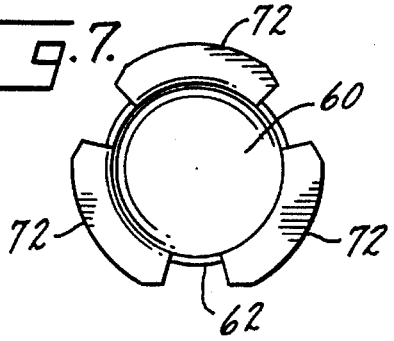
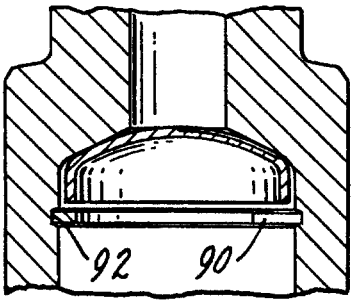
Fig. 13.
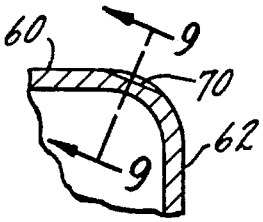
Fig. 8.
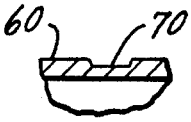
Fig. 9.
Fig. 14.
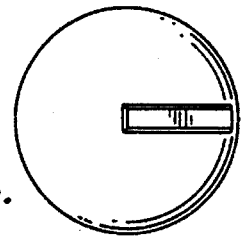

HYDRAULIC LASH ADJUSTER METERING VALVE

THE FIELD OF THE INVENTION

The present invention relates to hydraulic lash adjusters and principally to a metering valve for use in such a lash adjuster. The lash adjuster disclosed in the present application is of the type in which the plunger nose is socketed directly into the rocker arm of the engine valve train. Such a lash adjuster requires a metered amount of hydraulic fluid or oil to lubricate the socket and the metering valve of the present invention functions to that end.

THE PRIOR ART

U.S. Pat. No. 3,502,058 to Thompson shows a lash adjuster of the type generally disclosed herein which has a passage in the plunger cap to lubricate the rocker arm socket. There is no metering valve.

U.S. Pat. No. 3,838,669 to Dadd shows a hydraulic lash adjuster of the type generally disclosed herein and has as a metering valve a cup-shaped member which uses the clearance between the exterior of the cup wall and the interior of the plunger body to meter fluid flow.

U.S. Pat. No. 4,009,696 to Cornell shows a lash adjuster of the type disclosed herein in which the lubricating oil for the rocker arm socket is metered on the exterior of the lash adjuster.

U.S. Pat. No. 4,004,558 to Scheibe shows a lash adjuster of the type disclosed herein utilizing a snap-fit metering valve within the passage in the plunger cap to meter oil to the rocker arm socket.

SUMMARY OF THE INVENTION

The present invention relates to hydraulic lash adjusters for use in vehicle internal combustion engines and particularly to an improved metering valve therefor.

A primary purpose of the invention is a lash adjuster in which the plunger end is socketed into the rocker arm and has a metering valve to control lubrication of the rocker arm socket.

Another purpose is a lash adjuster of the type described which is simple in construction, reliable in operation, and although movable, cannot invert during engine operation.

Another purpose is a lash adjuster metering valve of the type describe which functions to purge impurities in the space between the metering valve and its seat at engine start-up.

Another purpose is a metering valve of the type described having a semi-spherical or conical metering valve surface which mates with a similar surface in the bore of the lash adjuster plunger.

Other purposes will appear in the ensuing specification, drawings and claims.

BRIEF DESCRIPTION OF THE DRAWINGS

The invention is illustrated diagrammatically in the following drawings wherein:

FIG. 1 is an axial section through the lash adjuster of the present invention;

FIG. 2 is a bottom view of the metering valve of FIG. 1;

FIG. 3 is a side view of the metering valve of FIG. 1;

FIG. 4 is an enlarged partial section of the metering valve of FIG. 1;

FIG. 5 is an enlarged partial section of the metering valve of FIG. 1 illustrating the metering slot;

FIG. 6 is an axial section through a second embodiment of lash adjuster;

FIG. 7 is a bottom view of the metering valve of FIG. 6;

FIG. 8 is an enlarged partial section of the metering valve of FIG. 6;

FIG. 9 is a section along plane 9—9 of FIG. 8;

FIG. 10 is a partial axial section through a third embodiment of lash adjuster;

FIG. 11 is a bottom view of the metering valve of FIG. 10;

FIG. 12 is a section along plane 12—12 of FIG. 11;

FIG. 13 is a partial axial section through a fourth embodiment of lash adjuster; and FIG. 14 is a top view of the metering valve of FIG. 13.

DESCRIPTION OF THE PREFERRED EMBODIMENT

Hydraulic lash adjusters are utilized to take up clearance within the valve train of an internal combustion engine. There are various types of lash adjusters, most require metering valves of one sort or another in order to provide lubrication to the valve train connections of the lash adjuster. The present invention is particularly concerned with that type of lash adjuster which is socketed into the rocker arm. The lash adjuster will receive oil or hydraulic fluid from the engine lubricating pump through an oil gallery and this fluid will pass through communicating openings in the body and plunger cap of the lash adjuster. The amount of fluid supplied to the rocker arm socket is controlled by the metering valve which is located in the fluid path between the communicating holes in the plunger cap and body of the lash adjuster and the opening which provides fluid for the rocker arm socket. To meter flow to the passage in the plunger cap requires placement of the valve within the bore of the plunger cap. It is difficult to form a flat seat in the plunger cap bore and thus many of the prior art type of metering valves are unsuitable. The present invention provides a uniquely configured metering valve having a surface which is at least partly semi-spherical to mate with the cooperating conical end of the bore within the plunger cap.

In the embodiment of FIGS. 1–5, the body of the lash adjuster is indicated at 10 and conventionally will be seated within a bore in the engine cylinder head. The body 10 has a chamber 12 within which is mounted a two-piece reciprocal plunger cap 14. The plunger cap has an end portion indicated at 16 and there is a passage 18 in the portion 16 which connects to the hollow interior 20 of the plunger cap. The plunger cap semi-spherical nose 22 will be socketed within the rocker arm of the valve train.

A plunger return spring 24 is bottomed in the closed end of body 10 and urges the plunger cap outwardly toward the socket in the rocker arm. There is a high pressure chamber 26 formed between the lower end of plunger cap 14 and the closed end of body 10 and the return spring 24 is positioned within this chamber. The flow of oil from chamber 26 to plunger cap chamber 20 is controlled by a check valve 28 urged into a closing position by a valve spring 30 held in position by a valve cage 32 which in turn is supported on return spring 24. An exterior retainer 25 secures the plunger cap to the body 10.

Oil is supplied from the exterior of the lash adjuster to internal chamber 20 through a body oil feed hole 34 and a plunger cap oil feed hole 36. These openings overlap and oil will be supplied through the combined openings into the internal chamber 20 during engine operation.

In order to provide a metered amount of oil into plunger cap passage 18 there is a metering valve 38 which is located at the internal end of passage 18. Metering valve 38 has an exterior generally semi-spherical surface 40 which is formed and adapted to mate with a generally conical metering valve seat 42 formed at the termination of plunger cap passage 18. Metering valve 38 has a generally cylindrical wall 44 which adjoins the semi-spherical valve surface 40 and has a plurality of outwardly-extending projections 46 which extend both radially outwardly and axially toward the interior of chamber 20. The projections 46 and, although three are shown, there may be any number, are separated by gaps 48 which provide a degree of flexibility to the projections permitting them to be flexed during assembly of the lash adjuster.

The metering valve surface 40 has a radially extending groove or slot 50 which provides the metering valve passage to control the flow of hydraulic fluid from chamber 20 to oil passage 18. In the embodiment of FIGS. 1–5, slot 50 extends from generally adjacent cylindrical wall 44 to generally the center of surface 40 for communication with passage 18. The slot may have a controlled depth and width which determine the amount of fluid which is metered during operation of the engine.

In order to retain the metering valve within chamber 20, the interior wall 52 of plunger cap 14 has a ledge 54 which cooperates with the radial and axially extending projections 46 to support the metering valve closely adjacent surface 42 but yet at a distance to permit some axial movement relative thereto.

In operation, metering valve 38 can both rotate and pivot and move axially toward and away from surface 42. There is only a small diametrical clearance between cylindrical wall 44 and the interior wall 56 of the plunger cap chamber 20, with the result that the metering valve cannot become inverted or otherwise misaligned. It can, however, both rotate and move axially during operation, but in any seated position of the valve there will always be communication between chamber 20 and passage 18. This communication is through the diametrical clearance between cylindrical wall 44 of the valve and plunger cap bore wall 56, through slot 50 and then to passage 18.

Of particular advantage in the arrangement shown is that the metering valve can move axially back and forth toward valve seat surface 42. When the engine has been shut down the metering valve is supported on ledge 54. The initial flow of oil into chamber 20 at engine start-up will cause whatever oil is between the metering valve and surface 42, and which may include impurities brought about by the contact between the metering valve and its seat, to be purged outwardly through passage 18. During normal operation, where there is contact, and thus some degree of wear between the metering valve and its seat, there may be some small accumulated particles in the oil which will be immediately flushed as the engine is operated.

In the second embodiment of FIGS. 6–9, like numbers have been given to similar parts. The principal difference in this embodiment is in the shape of the metering valve. The metering valve has a rounded or partially semi-spherical surface with a generally flat center area, as indicated at 60. There is a cylindrical wall 62, again with a diametrical clearance with the internal wall 64 of the plunger cap chamber 20. The valve seat 42 is generally conical and there is only contact at the rounded edge 68 of the metering valve and the valve seat. Thus, the required slot to connect the plunger cap passage 18 and plunger cap chamber 20 is only at the rounded area 68, such slot being indicated at 70. Again, the width and depth of the slot will determine the amount of fluid metered during operation. In this instance, the outward retaining projections of the metering valve indicated at 72 are radial and cooperate with a ledge 54 similar to that indicated in the FIG. 1–5 embodiment.

In the third embodiment of FIGS. 10–12, the metering valve has a generally semi-spherical exterior surface 80 and a cylindrical side wall 82. A slot 84 is effective to connect the plunger cap passage 18 with the area exteriorly of the metering valve as in the earlier-described embodiments. In this particular configuration there are no outwardly-extending projections which provide the retaining means for the metering valve, rather, the bottom end of wall 82 seats upon ledge 86 and in a sense the wall may be considered an axial projection in that it is the retaining means for the metering valve. In operation, the valve of the FIG. 10–12 embodiment functions in the same manner as described earlier.

The fourth embodiment is illustrated in FIGS. 13 and 14, and is similar to the third embodiment in the construction of the metering valve. In this instance the metering valve is retained within the plunger cap by means of a retaining ring 90 which is seated within a groove 92 in the interior wall of the plunger cap chamber 20. In function and operation the fourth embodiment is the same as described earlier.

As can be understood by those skilled in the art, in order to provide a metering valve function within a confined and difficult to reach bore in the plunger cap, it is generally impossible to use a flat metering valve. It is difficult to machine a flat surface in such a confined area, and for this reason the metering valve seat is conical or semi-spherical. The metering valve has a mating conical or semi-spherical surface and there is a slot in the surface thereof which faces the seat, with this slot connecting the plunger cap passage with the diametrical clearance area between the exterior of the metering valve and the internal bore in the plunger cap. The metering valve is simple in construction, reliable, and can move both axially and radially without affecting its utility. The orientation of the radial slot or groove in the surface of the metering valve does not affect its function. The axial movement permitted has the advantage of purging of any debris in the fluid above the metering valve which might have accumulated during engine shutdown.

Whereas the preferred form of the invention has been shown and described herein, it should be realized that there may be many modifications, substitutions and alterations thereto.

The embodiments of the invention in which an exclusive property or privilege is claimed are defined as follows:

1. In a hydraulic lash adjuster for use in internal combustion engines, a cylindrical body having an internal chamber, a hollow plunger cap reciprocal in said body and having one end thereof extending outwardly from the body, a fluid passage extending through said plunger cap and in communication with the hollow interior of the plunger cap, fluid pressure feed openings in side walls of the body and plunger cap to supply fluid to the hollow interior of said plunger cap, spring means urging said plunger cap outwardly from said body, characterized by said plunger cap hollow interior having a generally conical metering valve seat at an internal termination of said plunger cap end fluid passage, and a metering valve positioned within said plunger cap hollow interior and having a metering surface, at least in part generally semi-spherical, formed and adapted to seat against said metering valve seat, said metering surface having a fluid passage formed therein communicating with said plunger cap end fluid passage and the hollow interior of said plunger cap, whereby a metered amount of fluid is provided from the interior of said plunger cap to the outwardly extending end thereof during vehicle combustion engine operation.

2. The hydraulic lash adjuster of claim 1 further characterized by and including means in said plunger cap retaining said metering valve adjacent but spaced from said metering valve seat whereby said metering valve is movable toward and away from said valve seat, with movement toward said valve seat, after engine shutdown, flushing any accumulated debris between said metering valve and metering valve seat outwardly through said plunger cap end passage.

3. The hydraulic lash adjuster of claim 2 further characterized in that said retaining means include a retaining ring mounted within said plunger cap hollow interior.

4. The hydraulic lash adjuster of claim 2 further characterized in that said retaining means includes a ledge formed on the hollow interior of said plunger cap, and cooperating projection means on said metering valve.

5. The hydraulic lash adjuster of claim 4 further characterized in that said projection means extend toward said ledge.

6. The hydraulic lash adjuster of claim 4 further characterized in that said projection means extends toward a side wall of said plunger cap hollow interior.

7. The hydraulic lash adjuster of claim 1 further characterized in that said metering valve is both axially movable and rotatable relative to said metering valve seat.

8. The hydraulic lash adjuster of claim 1 further characterized in that said metering valve surface fluid passage is a generally radial slot.

9. The hydraulic lash adjuster of claim 8 further characterized in that said generally radial slot extends from adjacent the periphery of said metering valve surface to generally the center thereof.

10. The hydraulic lash adjuster of claim 8 further characterized in that said metering valve has a generally cylindrical side wall adjoining said metering valve surface, there being diametrical clearance between said side wall and the hollow interior of said plunger cap for the passage of fluid to said radial slot.

11. The hydraulic lash adjuster of claim 10 further characterized in that said radial slot extends generally from the area of said metering valve surface adjacent said side wall to generally the center of said metering valve surface.

12. The hydraulic lash adjuster of claim 10 further characterized in that said radial slot extends from generally the area of said cylindrical side wall toward said plunger cap end passage.

* * * * *